US006987934B2

(12) United States Patent
Bessho et al.

(10) Patent No.: US 6,987,934 B2
(45) Date of Patent: Jan. 17, 2006

(54) IMAGE FORMING APPARATUS

(75) Inventors: Yuji Bessho, Chiba (JP); Koji Masuda, Ibaraki (JP); Tadashi Fukuda, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 41 days.

(21) Appl. No.: 10/793,205

(22) Filed: Mar. 3, 2004

(65) Prior Publication Data

US 2004/0197110 A1 Oct. 7, 2004

(30) Foreign Application Priority Data

Mar. 7, 2003 (JP) ..... 2003-061616

(51) Int. Cl.
*G03G 15/08* (2006.01)

(52) U.S. Cl. ..... 399/27; 399/61; 399/260

(58) Field of Classification Search ..... 399/27, 399/53, 61, 258, 260
See application file for complete search history.

(56) References Cited

U.S. PATENT DOCUMENTS 5,198,861 A * 3/1993 Hasegawa et al. ..... 399/27
5,708,918 A * 1/1998 Okuno et al. ..... 399/61
5,875,381 A * 2/1999 Moser ..... 399/324
5,970,276 A * 10/1999 Kato ..... 399/53
6,167,211 A * 12/2000 Oogi et al. ..... 399/53
6,345,162 B1 * 2/2002 Ozawa et al. ..... 399/61
6,415,114 B1 * 7/2002 Nakazato et al. ..... 399/53
6,640,060 B2 * 10/2003 Yamaguchi et al. ..... 399/27
2004/0101333 A1 * 5/2004 Wu et al. ..... 399/325

FOREIGN PATENT DOCUMENTS

JP 08-110700 A 4/1996
JP 10-039608 A 2/1998
JP 2001-296732 A 10/2001

* cited by examiner

*Primary Examiner*—G. Bradley Bennett
(74) *Attorney, Agent, or Firm*—Canon U.S.A. I.P. Div

(57) ABSTRACT

In a device for controlling the amount of toner replenished to a developing device depending on the density of a reference image formed on a photoconductor, if the toner density of a developer in the developing device fluctuates extremely; there may occur toner scattering, formation of coarse or rough images, and carrier attachment. To overcome those problems, a photosensor is disposed to detect the toner density in the developing device, and when an output of the photosensor is outside of a predetermined range, a target value to be compared with the detected density of the reference image is modified.

14 Claims, 10 Drawing Sheets

IMAGE FORMING APPARATUS

BACKGROUND OF THE INVENTION

1. Field of the Invention

The present invention relates to an image forming apparatus utilizing, for example, an electrophotographic or electrostatic recording process, and more particularly to an image forming apparatus such as a copier, a printer or a FAX machine.

2. Description of the Related Art

An electrophotographic process is one of the most known printing processes often utilized in copiers and printers. Recently, more attention upon POD (print on demand) has increased demands for a printing capability at higher speed, photographic image printing, etc. As a result, printers capable of producing finer images with higher quality have been demanded.

In general, developing devices equipped in image forming apparatuses utilizing the electrophotographic or electrostatic recording process employ a one-component developer containing a magnetic toner as a main component or a two-component developer containing a non-magnetic toner and a magnetic carrier as main components. In color image forming apparatuses utilizing the electrophotographic process to form full-color and multicolor images, especially, most of developing devices employ a two-component developer for the purpose of obtaining more satisfactory color tints of images.

As well known, a toner density (i.e., a ratio of toner weight to total weight of the carrier and the toner) of the two-component developer is a very important factor from a point of stabilizing image quality. The toner in the developer is consumed in a developing step, and the toner intensity of the developer reduces correspondingly. It is therefore necessary to detect the toner (developer) density or the image density at the appropriate times by using a developer density controller or an image density controller, and to replenish the toner depending on a detected density change so that the toner density or the image density is always controlled to be constant and image quality is held at a satisfactory level. FIG. 2 shows an example of overall construction of an image forming apparatus, e.g., an electrophotographic digital copier, equipped with a known density controller.

First, an image of a document 31 is read by a CCD 1. A resulting analog image signal is amplified to a predetermined level by an amplifier 2 and converted into a digital image signal of, e.g., 8 bits (0 to 255 levels of halftone) by an analog-digital converter (A/D converter) 3. Then, the digital image signal is supplied to a γ-converter (which is constructed as a 256-byte RAM and performs density conversion using a lookup table in this example). Further, the digital image signal is subjected to γ-compensation and inputted to a digital-analog converter (D/A converter) 9.

The digital image signal is converted again into an analog image signal by the D/A converter 9 and supplied to one input terminal of a comparator 11. A triangular wave signal generated from a triangular wave generator 10 and having a predetermined period is supplied to the other input terminal of the comparator 11. The analog image signal supplied to the one input terminal of the comparator 11 is compared with the triangular wave signal for pulse width modulation. A binary image signal having been subjected to the pulse width modulation is inputted, as it is, to a laser driver 12 and used as an on/off control signal for causing a laser diode 13 to emit a laser beam. The laser beam emitted from the laser diode 13 is scanned by a known polygonal mirror 14 in the direction of main scan and is illuminated through an f/θ-lens 15 and a reflecting mirror 16 onto a photoconductive drum 40. The photoconductive drum 40 serves as an image carrying member and is rotated in the direction denoted by an arrow (a in FIG. 3). An electrostatic latent image is thus formed.

On the other hand, after uniform charge cancellation by an exposure device 18, the photoconductive drum 40 is uniformly charged to be, e.g., negative by a primary charger 19. Then, the photoconductive drum 40 is exposed to the illumination of the laser beam; as described above, whereupon an electrostatic latent image is formed in accordance with the image signal.

The electrostatic latent image is developed into a visible image (toner image) by a developing device 20. A toner replenishing tank 8 containing a make-up toner 29 is provided above the developing device 20, and a toner feed screw 30 is mounted at the bottom of the toner replenishing tank 8. The toner feed screw 30 is rotated by a motor 28 to feed the toner 29 for supply into the developing device 20.

The toner image formed on the photoconductive drum 40 is transferred under an action of a transfer charger 22 onto a transfer material P, which has been transported to the photoconductive drum 40 by a transfer material carrying belt 17. The transfer material carrying belt 17 is stretched between two rollers 25*a* and 25*b* and is endlessly driven to move in the direction denoted by an arrow in FIG. 2, thus transporting the transfer material P held on it to the photoconductive drum 40. The toner remaining on the photoconductive drum 40 after the image transfer is scraped off by a cleaner 24.

For simplicity of the explanation, FIG. 2 shows only a single image forming station (including the photoconductive drum 40, the exposure device 18, the primary charger 19, the developing device 20, etc.). In the case of a color image forming apparatus, however, image forming stations corresponding to respective colors, e.g., cyan, magenta, yellow and black, are successively arranged along the transfer material carrying belt 17 in the direction of movement thereof.

FIG. 3 shows one example of the developing device 20.

In the example of FIG. 3, the developing device 20 comprises a development container 52 containing a two-component developer (21 in FIG. 2), and a development sleeve 58 serving as a developer carrying member and rotatably mounted in the development container 52 with a predetermined gap left relative to the photoconductive drum 40. The development sleeve 58 is constituted as a cylindrical member made of a non-magnetic material, and a magnet roller 59 serving as a magnetic field generating means is disposed inside the development sleeve 58 to be held stationary with respect to the rotation of the development sleeve 58 denoted by an arrow c. The magnet roller 59 has five magnetic poles N1, S1, N2, N3 and S2. A restriction blade 131 as a magnetic member is attached to a portion of the development container 52 positioned above the development sleeve 58. The restriction blade 131 is disposed in non-contact relation to the development sleeve 58 such that its lower end is extended to and located near the magnetic pole S2 which is positioned substantially at a top point of the magnet roller 59 in the vertical direction. A pair of developer feed screws 54, 56 are disposed in a lower portion of the development container 52.

The two-component developer contained in the development container 52 is supplied to the development sleeve 58 while circulating in the development container 52 with agitating and feeding actions of the developer feed screws 54, 56. The developer supplied to the development sleeve 58 is drawn up onto the development sleeve 58 by an action of the magnetic pole N3 of the magnet roller 59. With the rotation of the development sleeve 58, the developer is carried over the development sleeve 58 from the magnetic pole S2 to the magnetic pole N1 and then reaches a developing area where the development sleeve 58 and the photoconductive drum 40 are positioned to face each other. While being carried to the developing area, a layer thickness of the developer is magnetically restricted by the restriction blade 131 in cooperation with the magnetic pole S2 so that a thin layer of the developer is formed on the development sleeve 58.

The magnetic pole N1 of the magnet roller 59, positioned in the developing area, serves as a main pole for development. The developer carried to the developing area is heaped up by an action of the magnetic pole N1 and comes into contact with the surface of the photoconductive drum 40, whereby the electrostatic latent image formed on the surface of the photoconductive drum 40 is developed. After developing the latent image, the developer exits the developing area with the rotation of the development sleeve 58 and is returned to the development container 52 through the magnetic pole S1 serving as a carrying pole. The developer is then removed from the development sleeve 58 for recovery under repulsive magnetic fields produced by the magnetic poles N2, N3.

Such an image forming apparatus includes any type of density controller (ATR (Auto Toner Replenishment) unit) for the purposes of controlling replenishment of the toner to the developer 21 in the developing device 20 in which the toner density has reduced with repetition of the developing step described above, and controlling the toner density of the developer or the image density to be kept constant.

In practice, there are known a control method of detecting the toner density of the developer 21 in the developing device 20 based on the intensity of light reflecting from the developer by using a toner density sensor 23 mounted in the developing device 20 (called "developer reflection ATR"), a control method of forming a reference patch image 26 on the photoconductive drum 40 and detecting the density of the patch image 26 by a sensor 27, e.g., a potential sensor, disposed in opposite relation to the photoconductive drum 40 (called "patch check ATR"), and a control method of computing the amount of required toner from a level of a digital image signal for each pixel output from a video counter 4 (called "video counter ATR").

In any of those control methods, based on the obtained information, a CPU 6 controls rotation of a motor 28 through a motor driver 7. Correspondingly, replenishment of the toner to the developer 21 in the developing device 20 is controlled so as to keep constant the toner density of the developer or the image density.

Additionally, it is also proposed, for example, to correct an initial value used in the patch check ATR or the developer reflection ATR based on a result of the patch check, and to correct the amount of replenished toner based on a result of the patch check at the appropriate times while mainly employing the video counter ATR.

In those control methods, generally, the amount of replenished toner or a correction amount thereof is decided depending on the difference between an actual patch density and an initial patch density as shown in, by way of example, in FIG. 4. As the difference from the initial patch density increases, the amount of replenished toner is increased.

More specifically, according to any of those control methods, when the patch density is determined to be high (dark), control is performed to provide a proper patch density with consumption of the toner through the image forming process. On the other hand, when the patch density is determined to be low (light), control is performed to provide a proper patch density by directly replenishing the toner or correcting an initial value in the developer reflection ATR, etc.

Prior to the start of such control, it is preferable to experimentally confirm the amount of replenished toner with respect to the amount of rotation of the toner feed screw 30.

In two-component developing devices practiced so far, developer density controllers utilizing methods of directly measuring the toner density (e.g., the so-called optical ATR and inductance control) are intended to primarily realize stability in the toner density. Therefore, the toner density is stabilized, but those controllers cannot follow a variation in the amount of toner charge (hereinafter also referred to as "tribo-charge") caused by, e.g., changes in the charging capability of the carrier, non-operation for a long time, and abrupt changes in ambient environment of the image forming apparatus. As a result, fluctuations beyond an allowable range may occur in color tint and image density. There is hence still room for improvement in that type of controller.

Meanwhile, the so-called patch check ATR has also hitherto been practiced for the purpose of keeping constant the amount of toner developed on the photoconductive drum. The patch check ATR comprises the steps of forming a predetermined reference patch on the photoconductive drum at the appropriate times, comparing the detected density of the reference patch with the initial density, and executing toner replenishment control in accordance with a result of the comparison.

The patch check ATR has two functions of avoiding fluctuations in image density and color tint and performing toner density control by keeping constant the toner amount of the reference patch on the photoconductive drum. Also, keeping constant the toner amount of the reference patch on the photoconductive drum by the patch check ATR contributes to reducing fluctuations in the amount of toner charge and hence stabilizing the electrostatic transfer subsequent to the developing step. Consequently, the image density can be held in an allowable fluctuation range, and fluctuations in the color tint can also be held down small.

However, the patch check ATR control may cause extreme fluctuations in the toner density and bring about a trouble because the toner density is controlled to suppress a variation in the amount of toner charge caused by, e.g., changes in the charging capability of the carrier, non-operation for a long time, and abrupt changes in ambient environment of the image forming apparatus, aiming at control to keep constant the image density of the reference patch. For example, when the toner density extremely increases, toner scattering may occur, and when the toner density extremely decreases, a coarse or rough image and carrier attachment may occur.

Furthermore, in apparatuses disclosed in Japanese Patent Laid-Open Nos. 08-110700, 10-039608, and 2001-296732, it is proposed to perform toner replenishment control of deciding the amount of replenished toner from an output of a device (e.g., a photosensor or inductance sensor) for directly measuring the toner density as described above, to form a reference patch image at the appropriate times, and to correct the amount of replenished toner, which has been determined based on the output of the toner-density directly measuring device, in accordance with a detected density of the reference patch image.

However, such a method is intended for the toner replenishment control primarily aiming at stabilization of the toner density in the developing device, and does not take into account fluctuations in the image density and the color tint as main factors. For that reason, the disclosed apparatuses also still have room for improvement.

SUMMARY OF THE INVENTION

It is an object of the present invention to provide an image forming apparatus, which can prevent the occurrence of a trouble, such as toner scattering, while suppressing fluctuations in the image density.

To achieve the above object, the image forming apparatus of the present invention comprises a developing device for developing an electrostatic image formed on an image carrying member with a developer containing a toner and a carrier; an image density sensor for detecting a density of a toner image formed by the developing device; a control unit for controlling an amount of toner replenished to the developing device depending on an output of the image density sensor; a toner density sensor for detecting a toner density in the developing device; and a correcting unit for correcting the amount of replenished toner, which is decided depending on the output of the image density sensor, in accordance with an output of the toner density sensor.

Further objects, features and advantages of the present invention will become apparent from the following description of the preferred embodiments with reference to the attached drawings.

DESCRIPTION OF THE PREFERRED EMBODIMENTS

An image forming apparatus of the present invention will be described in detail below with reference to the drawings.

First Embodiment

A first embodiment of the present invention will be described with reference to FIGS. 1, 3, 5 and 6.

A description will first be made of the overall construction of one embodiment of the image forming apparatus according to the present invention with reference to FIG. 1. This embodiment represents the case in which the present invention is applied to an electrophotographic digital copier, but the present invention is similarly applicable to other various types of image forming apparatuses using an electrophotographic or electrostatic recording process.

Figure 1:
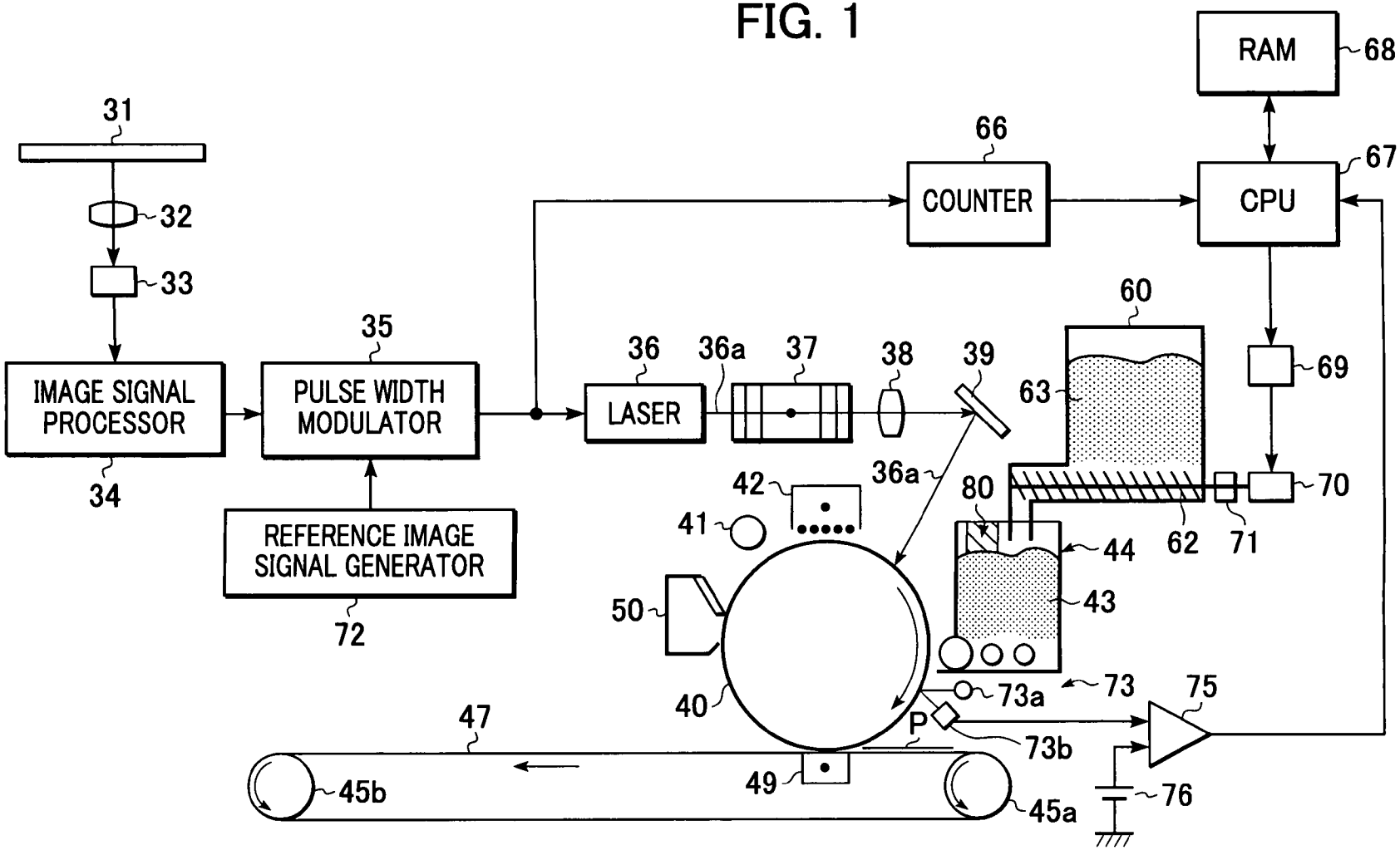
FIG. 1 is a schematic view showing the overall construction of an image forming apparatus according to any of first to fourth embodiments of the present invention.
Figure 2:
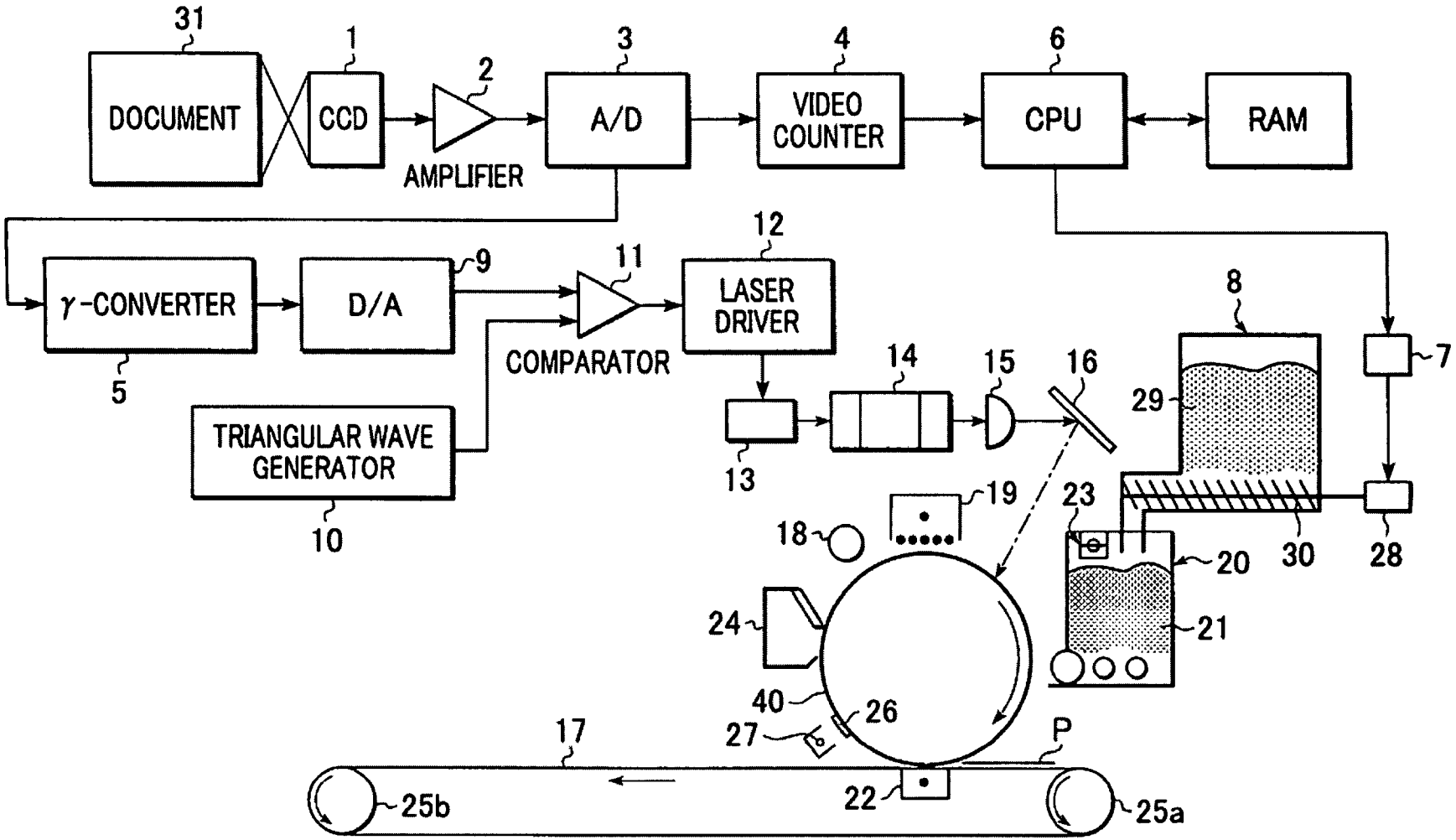
FIG. 2 (PRIOR ART)
FIG. 2 is a schematic view showing one example of a known image forming apparatus.

Referring to FIG. 1, an image of a document 31 to be copied is projected onto an image pickup device 33, e.g., a CCD, through a lens 32. The image pickup device 33 decomposes the document image into a large number of pixels and generates a photoelectrically converted signal corresponding to the density of each pixel. An analog image signal output from the image pickup device 33 is sent to an image signal processor 34 for conversion into a pixel image signal (input image density signal) having an output level corresponding to the density of each pixel. The pixel image signal is sent to a pulse width modulator 35.

For each of the input pixel image signals, the pulse width modulator 35 forms and outputs a laser driving pulse with a width (time length) corresponding to a level of the input signal. More specifically, as shown at (a) in FIG. 5, the pulse width modulator 35 forms a driving pulse W with a large width for the pixel image signal representing a high density, a driving pulse S with a small width for the pixel image signal representing a low density, and a driving pulse M with a medium width for the pixel image signal representing a medium density.

The laser driving pulse output from the pulse width modulator 35 is supplied to a semiconductor laser 36, causing the semiconductor laser 36 to emit a laser beam for a time corresponding to the width of the supplied pulse. Accordingly, the semiconductor laser 36 is driven for a longer time for a high density pixel and is driven for a shorter time for a low density pixel. A photoconductive drum 40 is hence exposed, through an optical system described later, over a longer range in the direction of main scan corresponding to the high density pixel and over a shorter range in the direction of main scan corresponding to the low density pixel. In other words, the dot size of an electrostatic latent image differs depending on the pixel density. As a matter of course, therefore, the amount by which toner is consumed to form the high density pixel is larger than the amount by which toner is consumed to form the low density pixel. In (d) of FIG. 5, L, M and H denote respectively electrostatic latent images corresponding to the low, medium and high density pixels.

A laser beam 36*a* emitted from the semiconductor laser 36 is swept by a rotating polygonal mirror 37 and is focused to a spot on the photoconductive drum 40, serving as an image carrying member, through a lens 38, e.g., an f/θ-lens, and a fixed mirror 39 for directing the laser beam 36*a* toward the photoconductive drum 40. Thus, the laser beam 36*a* scans over the surface of the photoconductive drum 40 in the direction substantially parallel to its rotation axis (i.e., in the direction of main scan), thereby forming an electrostatic latent image.

The photoconductive drum 40 is constituted as an electrophotographic photoconductive drum, which has a photoconductor layer of amorphous silicon, selenium or OPC, for example, formed on the surface and is rotated in the direction denoted by an arrow. After uniform charge cancellation by an exposure device 41, the photoconductive drum 40 is uniformly charged by a primary charger 42. Then, the photoconductive drum 40 is exposed to the scanned laser beam 36*a* having been modulated corresponding to the pixel image signal (image information), whereupon an electrostatic latent image is formed in accordance with the image information. The electrostatic latent image is subjected to reverse development and turned to a visible toner image by a developing device 44, i.e., a developing means, employing a two-component developer 43 in the mixed form of a toner and a carrier. Here, the term "reverse development" means a development process of attaching a toner, which is charged to the same polarity as a latent image, to an area of the photoconductive drum 40 having been exposed to the laser beam, thereby visualizing the latent image.

The thus-formed toner image is transferred under an action of a transfer charger 49 onto a transfer material P, which has been transported to the photoconductive drum 40 by a transfer material carrying belt 47. The transfer material carrying belt 47 is stretched between two rollers 45*a* and 45*b* and is endlessly driven to move in the direction denoted by an arrow in FIG. 1, thereby transporting the transfer material P held on it to the photoconductive drum 40. The transfer material P, onto which the toner image has been transferred, is separated from the transfer material carrying belt 47 and transported to a fusing device (not shown) for fusing the toner image into a permanent image. The toner remaining on the photoconductive drum 40 after the image transfer is removed by a cleaner 50.

For simplicity of the explanation, FIG. 1 shows only a single image forming station (including the photoconductive drum 40, the exposure device 41, the primary charger 42, the developing device 44, etc.). Because the image forming apparatus of this embodiment is a color image forming apparatus including image forming stations corresponding to respective colors, e.g., cyan, magenta, yellow and black, those image forming stations are successively arranged along the transfer material carrying belt 47 in the direction of movement thereof. Electrostatic latent images for each of colors resulting from color decomposition of a document image (i.e., for each color component of the image) are successively formed on respective photoconductive drums in the image forming stations. The latent images are developed by developing devices with developers containing toners of corresponding colors, and resulting toner images are successively transferred one above another onto the transferred material P having been transported by the transfer material carrying belt 47.

Figure 3:
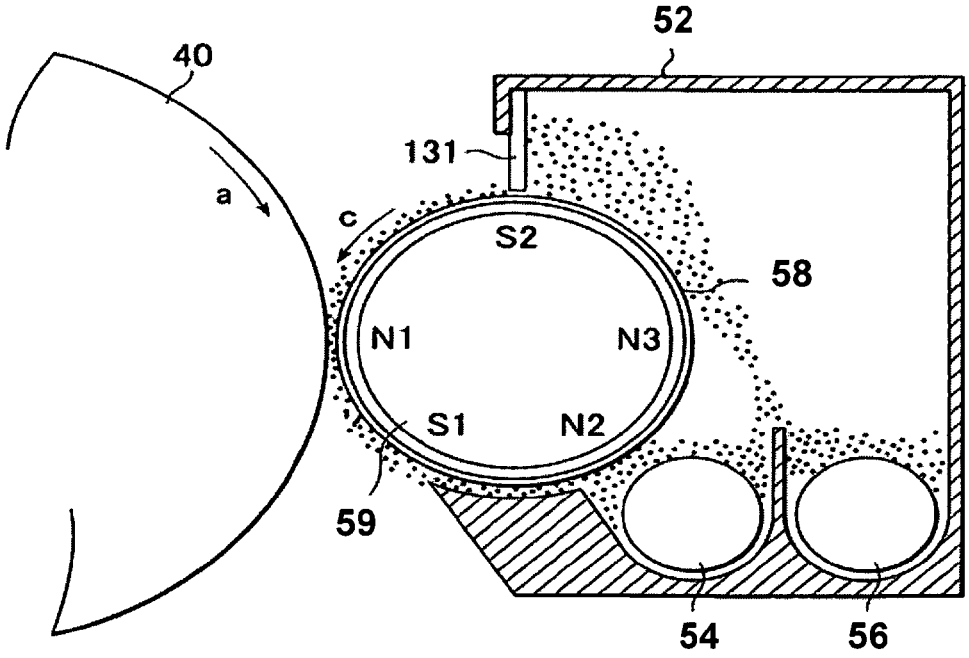
FIG. 3 (PRIOR ART)
FIG. 3 is a schematic view showing one example of a known developing device.
Figure 4:
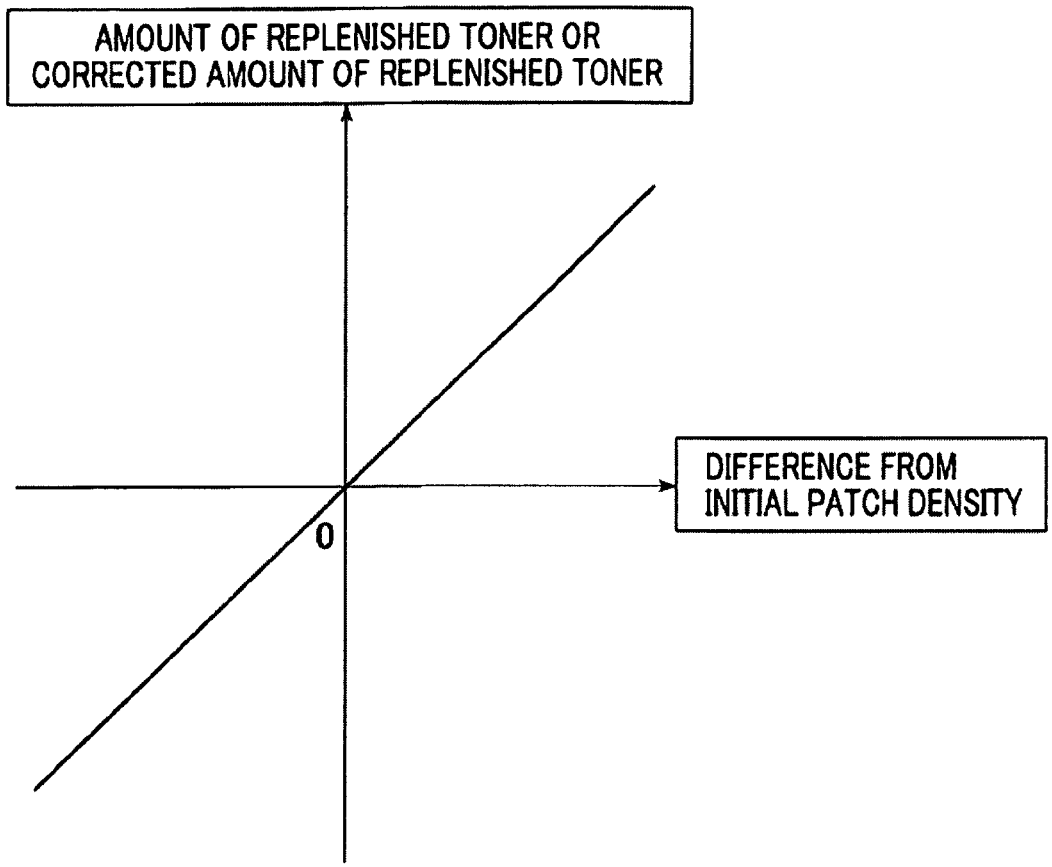
FIG. 4 (PRIOR ART)
FIG. 4 is a graph showing a known concept for deciding the amount (or corrected amount) of replenished toner depending on the patch density.
Figure 5:
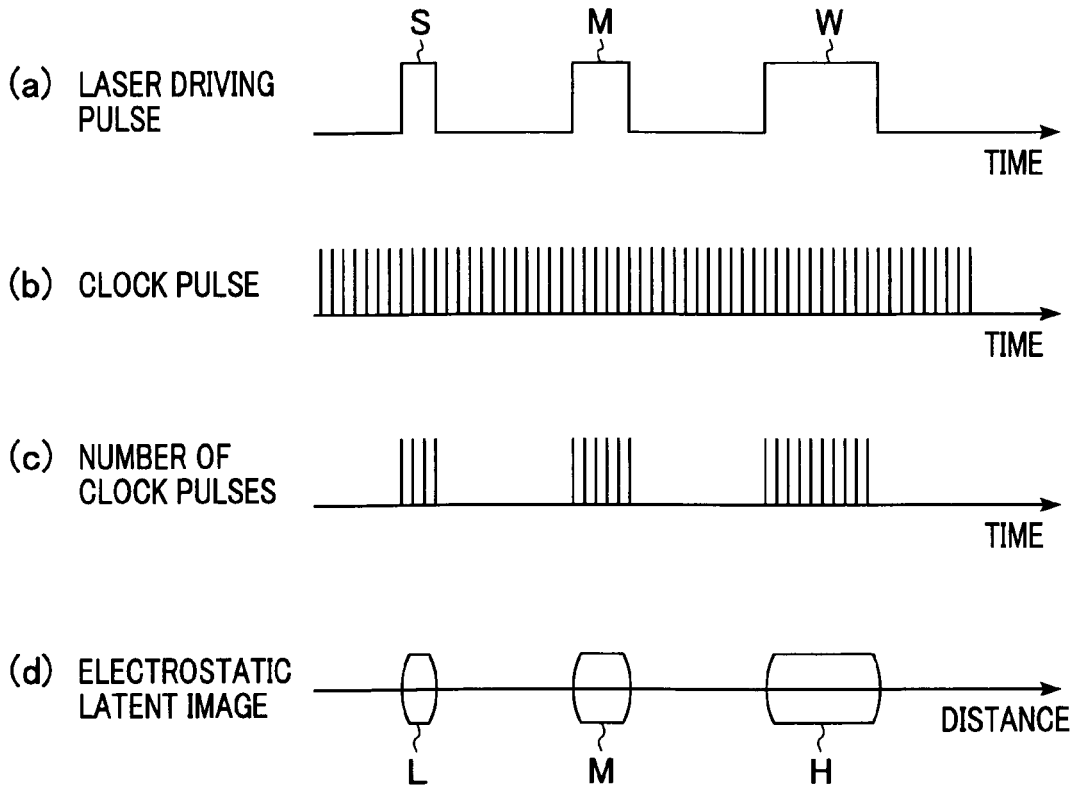
FIG. 5 is a chart for explaining laser signal control in each of the first to fourth embodiments.
Figure 6:
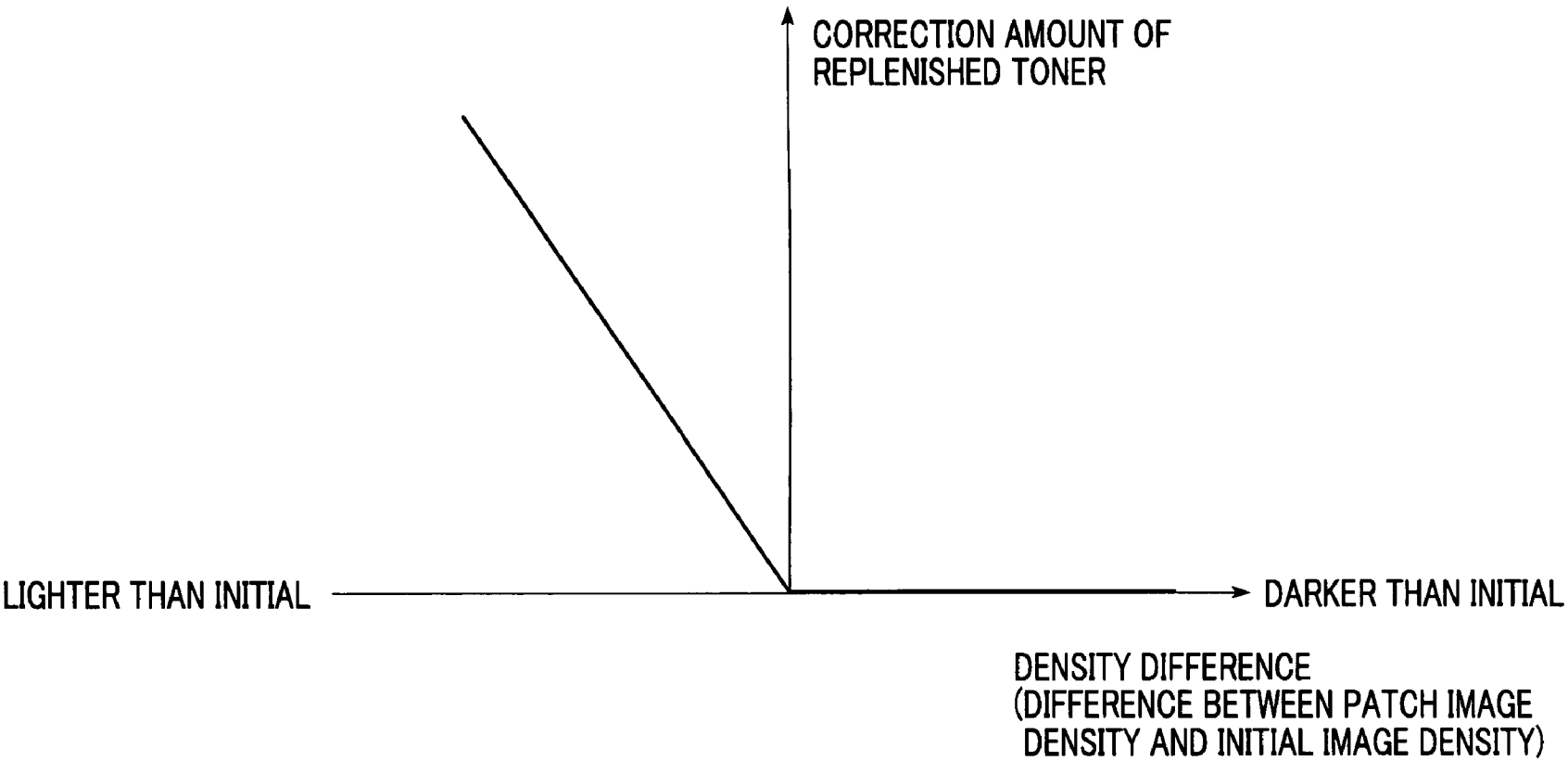
FIG. 6 is a graph showing the relationship between an output value of patch check control and an amount of replenished toner in the first embodiment.

Similarly to the developing device shown in FIG. 3, the developing device 44 comprises a development container containing a two-component developer that includes a magnetic carrier and a non-magnetic toner. A development sleeve serving as a developer carrying member and made of a non-magnetic material, e.g., SUS, is disposed in the development container in opposite relation to the rotating photoconductive drum 40. The other construction is the same as that shown in FIG. 3 and hence a description thereof is omitted here.

Above the developing device 44, as shown in FIG. 1, a toner replenishing tank 60 containing a make-up toner 63 is provided as a toner replenishing means, and a toner feed screw 62 is mounted at the bottom of the toner replenishing tank 60. The toner feed screw 62 is rotated by a motor 70 connected to the toner feed screw 62 through a gear train 71 so that the toner 63 in the toner replenishing tank 60 is supplied to the developing device 44. The operation of the toner feed screw 62 for supplying the toner is controlled by a CPU 67, serving as a control means, which controls the rotation of the motor 70 through a motor driver 69. A RAM 68 connected to the CPU 67 stores control data, etc. supplied to the motor driver 69.

A toner density sensor 80 is disposed in the developing device 44 and monitors the toner density during the image forming process. The toner density sensor 80 has a light receiving device for detecting a light resulting from reflection of an illuminated light by the developer. In this embodiment, the toner density is determined based on the intensity of the reflected light. Note that a magnetic sensor for detecting apparent permeability of the developer may be employed instead of such an optical sensor.

The toner density of the developer 43 in the developing device 44 reduces with repetition of the step of developing the electrostatic latent image. Therefore, a density controller performs replenishment control for replenishing the toner 63 from the toner replenishing tank 60 to the developing device 44 so that the toner density of the developer 43 or the image density is kept constant.

This embodiment employs, in such a density controller, a control method, called patch check ATR (Auto Toner Replenishment), of forming a reference patch image (corresponding to halftone) on the photoconductive drum 40 and detecting the density of the patch image by an image density sensor 73, i.e., an image density detecting means, comprising a light emitting unit 73*a* and a light receiving unit 73*b* both disposed in opposite relation to the photoconductive drum 40. Stated another way, according to the patch check ATR, a light emitted from the light emitting unit 73*a*, e.g., an LED, of the image density sensor 73 is illuminated to the formed patch image (toner image) and the light reflected from the patch image is received by the light receiving unit 73*b*, e.g., a photoelectric transducer, whereby the density of the patch image is detected.

Thus, in this embodiment, the amount of toner replenished to the developing device is controlled depending on an output of the sensor 73, i.e., the density of the reference patch image, so that the density of the reference patch image is held within a proper range.

Practically, the CPU 67 serving as a control means computes a difference between an output value of the sensor 73 and a target value stored in a storage, e.g., a RAM, decides the amount of replenished toner depending on the computed difference, and drives the motor 70 to rotate for a time corresponding to the decided amount of replenished toner.

In this embodiment, such toner replenishment control is performed with attention focused on a demand increasing in the market at the present, i.e., with intent to ensure a satisfactory density of a halftone image formed in the subsequent operation. In other words, unlike the related art, this embodiment makes the toner replenishment control so as to always hold the density of a halftone image formed on the photoconductive drum within a proper range while allowing some extent of fluctuations in the toner density and the amount of toner charge in the developing device.

To describe in more detail, a signal output from the light receiving unit 73*b* upon detection of the actual patch image density is supplied to one input terminal of a comparator 75. The other input terminal of the comparator 75 is supplied with a reference signal (target value) applied from a reference voltage signal source 76 and corresponding to a predetermined density (initial density) of the patch image. The comparator 75 compares the actual patch image density and the initial image density to determine a difference between them, and supplies an output signal representing the density difference to the CPU 67. This output signal representing the density difference is used to control the toner replenishment to the developer 43 in the developing device 44 in accordance with a graph of FIG. 6.

The image forming apparatus of this embodiment includes the image forming stations corresponding to four colors of cyan, magenta, yellow and black, and the above-described toner replenishment control is performed in each of those image forming stations per color. However, because the toner replenishment control is the same for each color, the following description is made of the toner replenishment control in one image forming station. Stated another way, although, in the image forming apparatus of this embodiment, four image forming stations are successively arranged along the transfer material carrying belt 47 so that a full-color image can be formed, those four stations are similarly constructed. Hence, FIG. 1 shows only one image forming station while the other three stations are omitted.

In the patch check ATR, as described above, the toner amount is controlled to a certain value depending on the density of the reference patch formed on the photoconductive drum 40. Accordingly, in the case of, for example, continuously forming many images each of which consumes a small amount of toner, relocation of the toner in the developer is suppressed and the amount of toner charge in the developer tends to increase (so-called charge-up).

In that case, in spite of the toner density in the developing device 44 being not so reduced, the density of the reference patch decreases because of the toner charge-up.

As a result, the CPU 67 receives information indicating that the toner in the developing device 44 is deficient. Therefore, the CPU 67 continues to replenish the toner, and the toner density in the developing device 44 continues to increase correspondingly. If the toner density in the developing device 44 increases too much, the toner may spill out of the developing device or the amount of toner scattering with the rotation of the development sleeve may abruptly increase.

On the other hand, for example, when the image forming operation is resumed from the state in which the image formation has not been performed for a long time, e.g., during summer vacation, the amount of toner charge is reduced because of the long-period non-operation, and the density of the reference patch increases.

In that case, the CPU 67 receives information indicating that the toner is excessively present in the developing device 44 in spite of the toner density remaining the same in the developing device during the long-period non-operation. Therefore, the CPU 67 continues to suppress the replenishment of the toner, and the toner density in the developing device 44 continues to decrease correspondingly. If the toner density in the developing device 44 decreases too much, an output image may become coarse or rough.

With the above problems in mind, this embodiment performs control such that the output of the toner density sensor 80 for detecting the density of the reference patch varies between predetermined upper and lower limit values.

More specifically, when the output of the toner density sensor 80 exceeds certain thresholds given by the predetermined upper and lower limit values, the CPU 67 corrects the initial target value of the image density sensor 73 (i.e., the target density) and performs control so as to hold the toner density in the developing device 44 within the threshold range.

As a result, the amount of toner charge can be maintained within a satisfactory range while executing the toner replenishment control in a manner capable of stabilizing the density of the image formed on the photoconductive drum 40.

Thus, the toner density in the developing device 44 can be held within a proper range while ensuring stability in the image density. Consequently, it is possible to provide, for a long term, stable images undergoing smaller fluctuations in color tint and image density without toner scattering and coarse or rough images. The toner replenishment control in this embodiment will be described in more detail below with reference to FIG. 7.

Figure 7:
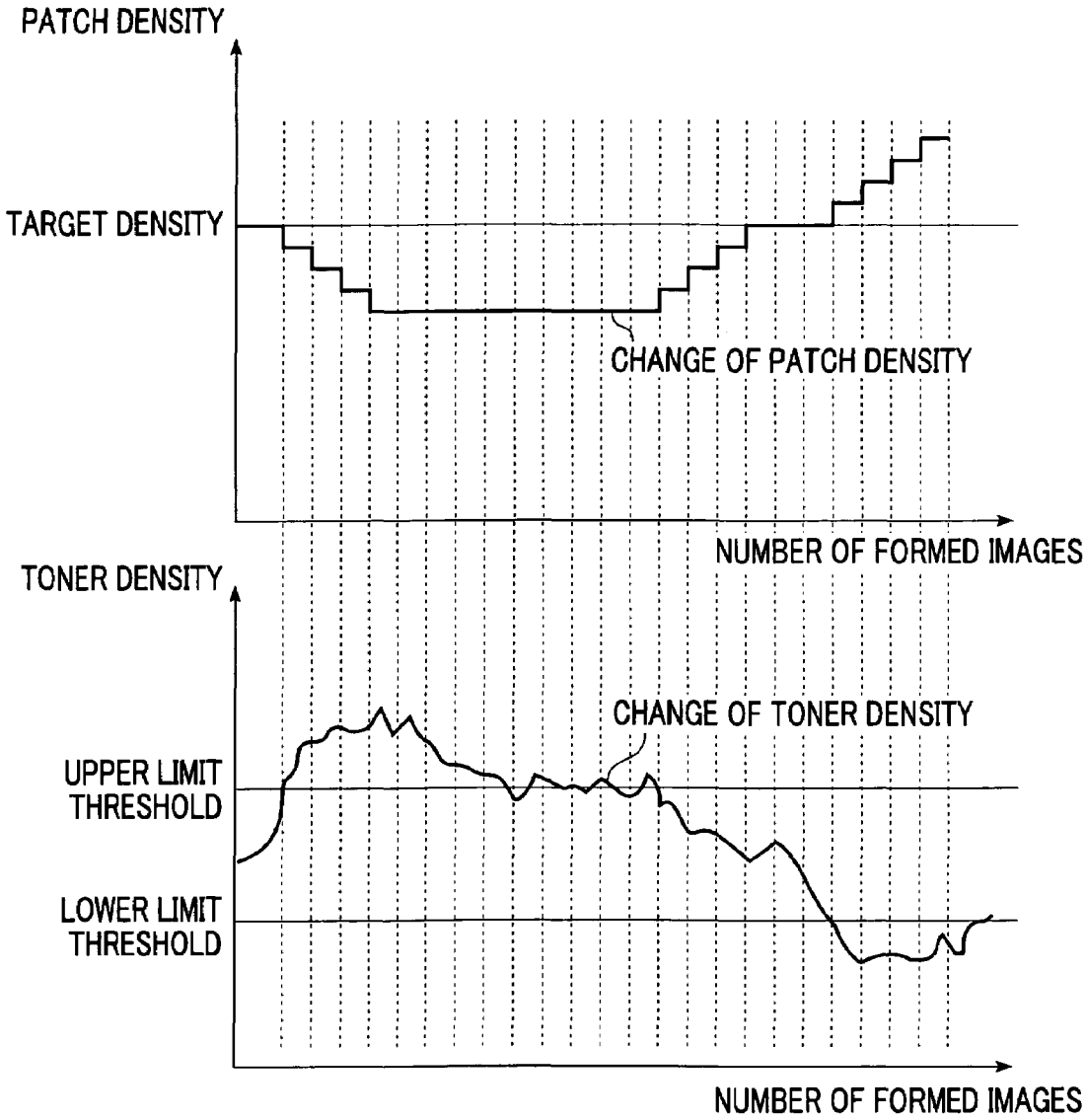
FIG. 7 is a graph showing the relationships among a developer (toner) density, a patch density and a patch density target in the first embodiment.

In FIG. 7, an upper graph shows changes of the patch image density and a lower graph shows changes of the toner density in the developing device 44.

When the toner replenishment control is performed so that the patch density comes closer to the target density, the toner density varies with repetition of the image formation as shown in the lower graph.

In this embodiment, therefore, when the toner density exceeds the upper and lower limit thresholds, the target value (target density) of the image density sensor 73 is modified as shown in the upper graph so that the toner density exceeding the thresholds are gradually returned to the threshold range.

As a result, the toner replenishment control can be performed in such a manner as suppressing an increase/decrease of the toner density in the developing device and stabilizing the image density.

On that occasion, because the target value of the image density sensor 73 is modified to a value different from the initial target value, there is a possibility that the amount of toner charge in the developing device may change to a large extent.

Also, abrupt correction of the target value of the image density sensor 73 may eventually cause large fluctuations in transfer efficiency due to changes in toner density and charge.

To cope with those problems, the CPU 67 preferably sets a correction amount of the target value of the image density sensor 73 in a step way. In other words, abrupt fluctuations in image density and color tint attributable to the correction of the target value can be minimized by performing not only control to avoid large changes in the density of the reference patch and the amount of toner charge, but also control to optimize the halftone compensating means and the setting of a transfer bias in accordance with the correction of the target value.

As another solution, it is also conceivable to switch over the control to another mode of deciding the amount of replenished toner depending on the output of the toner density sensor 80 when the toner density exceeds the thresholds. However, this solution cannot, as described above, follow changes in the amount of toner charge (tribo-charge) caused by various phenomena. Accordingly, unallowable fluctuations in color tint and image density tend to occur.

With this embodiment, the toner density can be held within the threshold range without causing such a disadvantage. Further, although the toner tribo-charge and the image density are changed upon modification of the target value of the image density sensor 73, the stepwise correction of the target value enables the toner tribo-charge and the image density to be gradually changed without causing abrupt changes. Hence, the correction of the target value is satisfactorily adaptable with the halftone control and the transfer control described above. Moreover, for the same reason as mentioned above, the target value is preferably returned to the initial value in a stepwise way when the toner density has come back to the proper range as intended.

As described above, troubles attributable to fluctuations in the amount of toner charge can be prevented while controlling the image density in an appropriate and stable manner, by employing not only the control process (patch check ATR) comprising the steps of forming a patch image for density reference on the photoconductive drum 40, detecting the density of the patch image by the image density sensor 73, and performing the toner replenishment control based on the detected result, but also the control process comprising the steps of detecting the toner density in the developing device 44 by the toner density sensor 80 disposed in the developing device, and using the detected result in correcting the amount of replenished toner, i.e., in correcting the target value of the toner density sensor, depending on the output of the toner density sensor. As a result, a color image with high quality can be formed.

As a modification, the toner density sensor 80 may be disposed outside the developing device 44 such that the toner density in the developing device is detected by the toner density sensor through a light transmissible window formed in the developing device.

As another modification, the patch image (toner image for reference) formed on the photoconductive drum 40 may be transferred onto the transfer material carrying belt 47 serving as a transfer medium in this case, and the density of the patch image may be detected by an image density sensor disposed in opposite relation to the transfer material carrying belt 47.

Second Embodiment

An image forming apparatus of a second embodiment is intended to directly control or modify the amount of toner replenished depending on the output of the image density sensor 73, when the toner density exceeds thresholds in a control process of monitoring the toner density by the toner density sensor disposed in the developing device 44 while performing the patch check ATR as the toner replenishment control. The other detailed construction is the same as that in the first embodiment and hence will not be described here.

In this embodiment, upper and lower limit thresholds are set in the toner density. When the toner density exceeds the thresholds, the amount of replenished toner decided depending on the difference between the actual image density detected by the image density sensor 73 and the initial target value is corrected to make control for keeping the toner density within the threshold range. Accordingly, the toner density can be held within a proper range while ensuring stabile control of the toner tribo-charge. As a result, it is possible to provide, for a long term, stable images undergoing smaller fluctuations in color tint and image density without toner scattering and coarse or rough images. The toner replenishment control in this embodiment will be described in more detail below with reference to FIG. 8.

Figure 8:
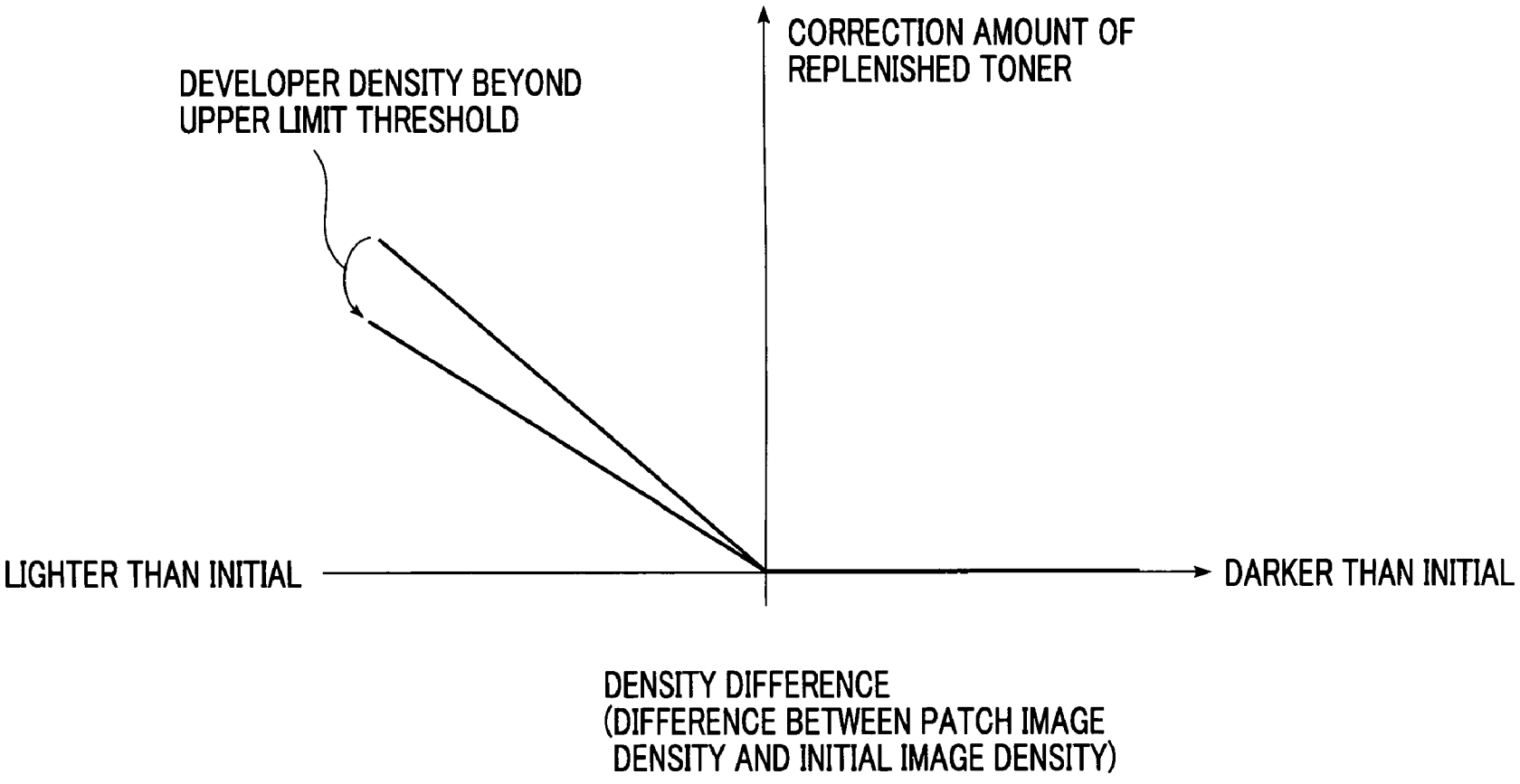
FIG. 8 is a graph for explaining a concept for correcting the amount of replenished toner based on the patch check in the second embodiment.

As in the first embodiment, when the toner replenishment control is performed so that the patch density comes closer to the target density, the toner density varies as shown in the lower graph of FIG. 7. In this embodiment, therefore, when the toner density exceeds the upper and lower limit thresholds, the amount of replenished toner decided depending on the difference between the patch density and the target density is corrected as shown in FIG. 8 (FIG. 8 shows the case in which the toner density exceeds the upper limit threshold, while no consideration is taken here for the case in which the toner density exceeds the lower limit threshold). As a result, an increase/decrease of the toner density is suppressed and the image density control can be performed in a stable manner. Further, the toner tribo-charge and the image density may change on that occasion for the same reasons as mentioned above. By correcting the amount of replenished toner in a stepwise way as in the first embodiment, however, the toner tribo-charge and the image density can be controlled to change gradually without causing abrupt changes. Hence, the correction of the amount of replenished toner is satisfactorily adaptable with the halftone control and the transfer control described above.

Additionally, in this embodiment, it is also conceivable to, by way of example, to increase the amount of replenished toner when the toner density exceeds the lower limit threshold. In such a case, the amount of replenished toner is preferably increased in units of a certain small value or in a stepwise way.

Thus, the toner density can be controlled so as to fall within a proper range while controlling the image density in an appropriate and stable manner, by employing not only the control process (patch check ATR) comprising the steps of forming a patch image for density reference on the photoconductive drum, detecting the density of the patch image by the image density sensor, and performing the toner replenishment control based on the detected result, but also the control process comprising the steps of detecting the toner density of the developer in the developing device by the toner density sensor disposed in the developing device, and using the detected result in correcting the amount of replenished toner which is decided based on the patch check ATR. As a result, a color image with high quality can be formed.

Third Embodiment

An image forming apparatus of a third embodiment is intended to perform the toner replenishment control in combination of a control process (video count ATR), which is performed based on a required toner amount computed from an output level of a digital image signal per pixel supplied from the video counter 66, with the patch check ATR.

More specifically, in this embodiment, the toner is replenished in an amount equal to the sum of the amount of replenished toner decided based on the video counter ATR and the amount of replenished toner decided based on the patch check ATR. In practice, there are various situations in which, for example, when the toner density is determined to be excessive based on the patch check ATR, the resulting toner amount is subtracted from the toner amount decided based on the video counter ATR.

The toner replenishment control is performed so as to keep the toner density within the threshold range through the steps of monitoring the toner density by the toner density sensor disposed in the developing device 44, and correcting the initial target value of the image density sensor 73 when the toner density exceeds the thresholds. The other construction is the same as that in the first embodiment and hence a description thereof is omitted here.

Figure 9:
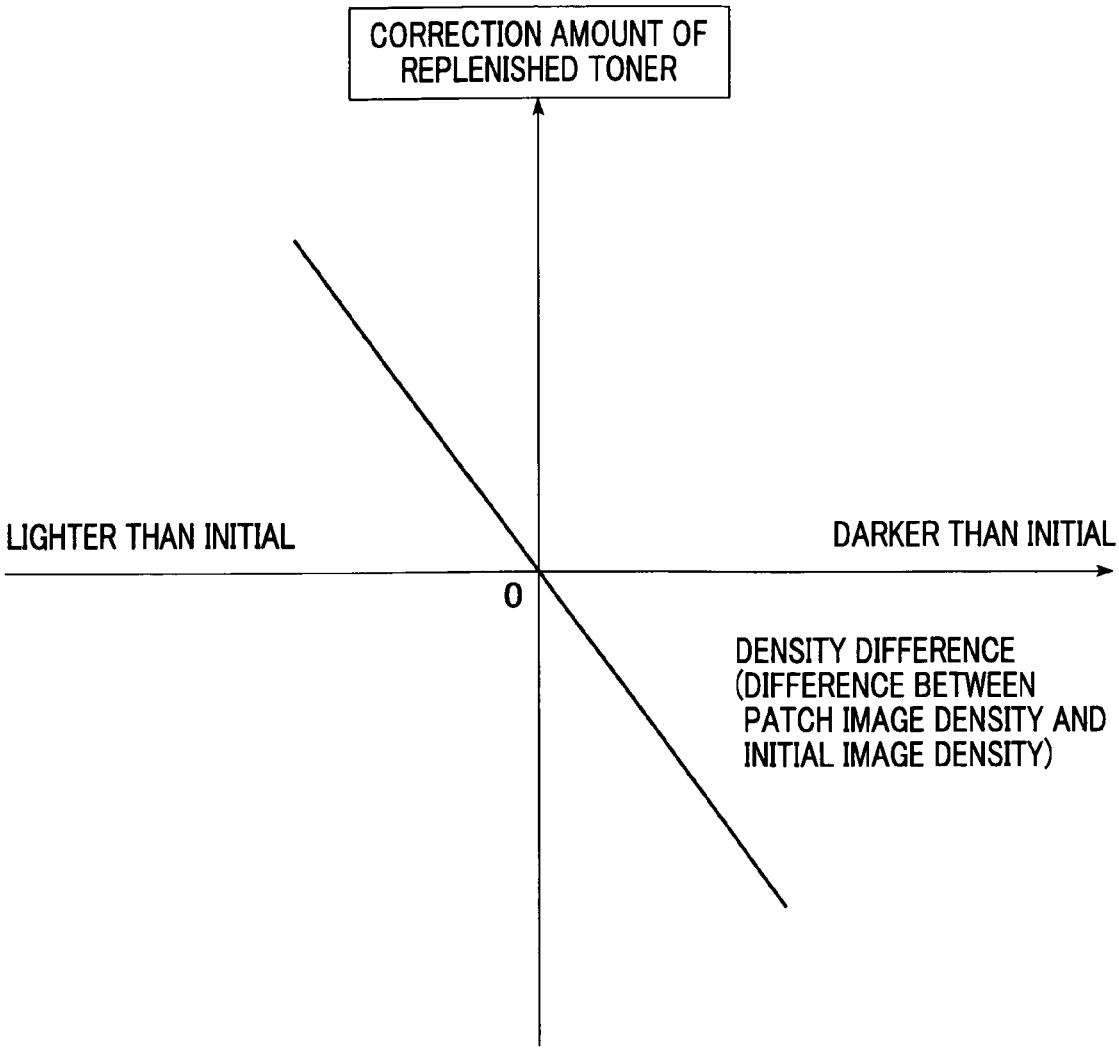
FIG. 9 is a graph for explaining a concept for correcting the amount of replenished toner based on the patch check in the third embodiment.

In the video counter ATR, the required toner amount is computed from an output level of a digital image signal per pixel of a document image, and the amount of toner replenished to the developer is controlled depending on the computed result. To compensate for a deviation between the amount of consumed toner and the amount of replenished toner, which is attributable to, e.g., a variation in the amount of replenished toner, a halftone patch image is formed at the appropriate times and the density of the formed patch image is compared with the initial density. Then, a correction amount of replenished toner decided depending on the comparison result while referring to a graph of FIG. 9 is fed back to the process of the video counter ATR for fine adjustment of the amount of replenished toner.

With such feedback control, the toner density is also held within a proper range while realizing stable control of the toner tribo-charge. As a result, it is possible to provide, for a long term, stable images undergoing smaller fluctuations in color tint and image density without toner scattering and coarse or rough images. The detailed control process is similar to that in the first embodiment described above with reference to FIG. 7 and hence will not be described here.

Thus, the toner density can be controlled so as to fall within a proper range while controlling the image density in an appropriate and stable manner, by employing not only the control process comprising the steps of computing the required toner amount from the output level of the digital image signal per pixel supplied from the video counter (based on video counter ATR) and finely adjusting the computed toner amount based on the patch check ATR, but also the control process comprising the steps of monitoring the toner density of the developer by the toner density sensor 80 disposed in the developing device 44, and using the detected result in correcting the target value (target density) of the image density sensor when the toner density exceeds the thresholds. As a result, a color image with high quality can be formed.

Fourth Embodiment

An image forming apparatus of a fourth embodiment is intended to perform the toner replenishment control in combination of a main control process (video count ATR), which is performed based on a required toner amount computed from an output level of a digital image signal per pixel supplied from the video counter, with a control process of finely adjusting the computed toner amount based on the patch check ATR and a control process comprising the steps of monitoring the toner density of the developer by the toner density sensor 80 disposed in the developing device 44, and controlling the amount of replenished toner decided based on the patch check ATR when the toner density exceeds the thresholds. Detailed constructions of the developing device and other components are the same as those in the first embodiment and hence will not be described here.

In this embodiment, upper and lower limit thresholds are set in the toner density. When the toner density exceeds the thresholds, the amount of replenished toner decided by the patch check ATR depending on the difference between the actual image density and the initial target value is corrected to make control for keeping the toner density within the threshold range. Accordingly, the toner density can be held within a proper range while ensuring stabile control of the toner tribo-charge. As a result, it is possible to provide, for a long term, stable images undergoing smaller fluctuations in color tint and image density without toner scattering and coarse or rough images. The toner replenishment control in this embodiment will be described in more detail below with reference to FIG. 10.

Figure 10:
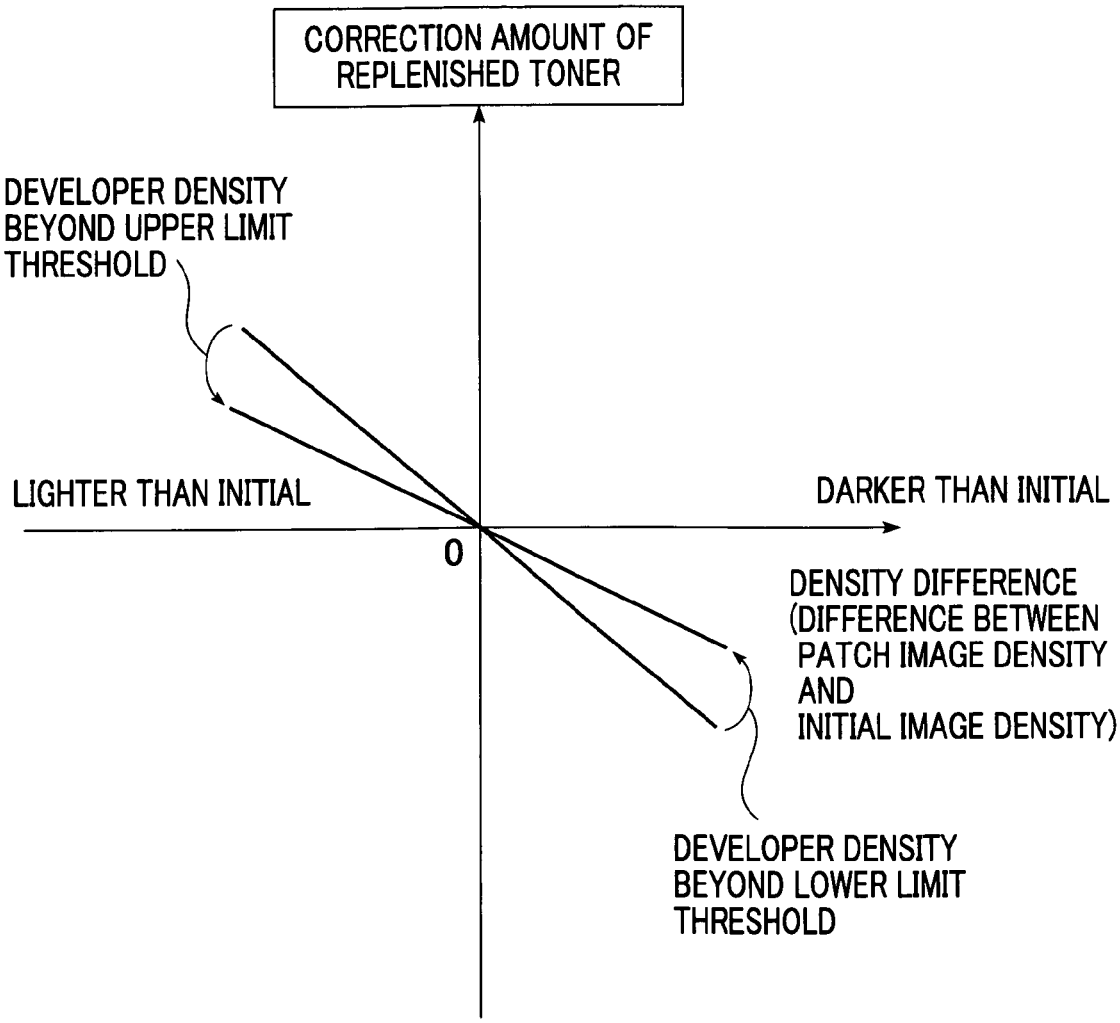
FIG. 10 is a graph for explaining a concept for correcting the amount of replenished toner based on the patch check in the fourth embodiment.

As in the first embodiment, when the toner replenishment control is performed so that the patch density comes closer to the target density, the toner density varies as shown in the lower graph of FIG. 7. In this embodiment, therefore, when the toner density exceeds the upper and lower limit thresholds, a correction amount of replenished toner decided depending on the difference between the patch density and the target density is corrected as shown in FIG. 10.

As a result, an increase/decrease of the toner density is suppressed and the image density control can be performed in a stable manner. Further, the toner tribo-charge and the image density may change on that occasion for the same reasons as mentioned above. By correcting the amount of replenished toner in a stepwise way as in the first embodiment, the toner tribo-charge and the image density can be controlled to change gradually without causing abrupt changes. Hence, the correction of the amount of replenished toner is satisfactorily adaptable with the halftone control and the transfer control described above.

Thus, the toner density can be controlled so as to fall within a proper range while controlling the image density in an appropriate and stable manner, by employing not only the control process comprising the steps of computing the required toner amount from the output level of the digital image signal per pixel supplied from the video counter (based on video counter ATR) and finely adjusting the computed toner amount based on the patch check ATR, but also the control process comprising the steps of monitoring the toner density of the developer by the toner density sensor 80 disposed in the developing device 44, and properly modifying the correction amount of replenished toner when the toner density exceeds the thresholds. As a result, a color image with high quality can be formed. In other words, the advantages of the present invention have been proved.

According to the embodiments described above, stable images undergoing smaller fluctuations in color tint can be steadily formed. Further, it is possible to prevent toner scattering otherwise occurred upon an excessive increase of the toner density in the developing device, and coarse or rough images otherwise formed upon an excessive decrease of the toner density.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a developing device for developing an electrostatic image formed on an image carrying member with a developer containing a toner and a carrier;

a toner replenishing apparatus configured to replenish the developing device with toner;

an image density sensor for detecting a density of a toner image formed by the developing device;

a determining unit determining an amount of toner replenishment by an output of the image density sensor in accordance with a predetermined relation;

a toner density sensor for detecting a toner density in the developing device; and correcting means for correcting the predetermined relation in accordance with the output of the toner density sensor.

2. An image forming apparatus according to claim 1, wherein the determining unit determines the amount of toner replenishment based on the output data of the image density sensor and a target value, and the correcting means corrects the target value in accordance with the output of the toner density sensor.

3. An image forming apparatus according to claim 2, wherein when the output of the toner density sensor is outside of a predetermined range, the correcting means corrects the target value in accordance with the output of the toner density sensor.

4. An image forming apparatus according to claim 3, wherein when the output of the toner density sensor is outside of the predetermined range, the correcting means gradually modifies the target value until reaching a new target value decided in accordance with the output of the toner density sensor.

5. An image forming apparatus according to claim 4, wherein the correcting means gradually modifies the target value each time a predetermined number of images are formed.

6. An image forming apparatus according to claim 1, further comprising image forming means for forming the electrostatic image on the image carrying member in accordance with an input image signal, wherein the determining unit determines the amount of toner replenishment depending on the image density signal and the amount of toner replenishment depending on the output data of the image density sensor.

7. An image forming apparatus according to claim 1, wherein the image density sensor is disposed in opposite relation to the image carrying member and detects the density of die toner image formed by the developing device.

8. An image forming apparatus comprising:

a developing device configured to develop an electrostatic image formed on an image carrying member with a developer containing a toner and a carrier;

a toner replenishing apparatus configured to replenish the developing device with toner;

an image density sensor configured to detect a density of a toner image formed by the developing device;

a determining unit determining an amount of toner replenishment by an output of the image density sensor in accordance with a predetermined relation;

a toner density sensor configured to detect a toner density in the developing device; and a correcting unit correcting the-predetermined relation in accordance with the output of the toner density sensor.

9. An image forming apparatus according to claim 8, wherein the determining unit determines the amount of toner replenishment based on the output data of the image density sensor and a target value, and the correcting unit corrects the target value in accordance with the output of the toner density sensor.

10. An image forming apparatus according to claim 9, wherein when the output of the toner density sensor is outside of a predetermined range, the correcting unit corrects the target value in accordance with the output of the toner density sensor.

11. An image fanning apparatus according to claim 10, wherein when the output of the toner density sensor is outside of the predetermined range, the correcting unit gradually modifies the target value until reaching a new target value decided in accordance with the output of the toner density sensor.

12. An image forming apparatus according to claim 11, wherein the correcting unit gradually modifies the target value each time a predetermined number of images are formed.

13. An image forming apparatus according to claim 8, further comprising an image forming unit configured to form the electrostatic image on the image carrying member in accordance with an input image signal, wherein the determining unit determines-the amount of-toner replenishment depend on the image density signal and the amount of toner replenishment depending on the output data of the image density sensor.

14. An image forming apparatus according to claim 8, wherein the image density sensor is disposed in opposite relation to the image carrying member and detects the density of the toner image formed by the developing device.

* * * * *

UNITED STATES PATENT AND TRADEMARK OFFICE

CERTIFICATE OF CORRECTION

PATENT NO. : 6,987,934 B2 
DATED : January 17, 2006
INVENTOR(S) : Bessho, Yuji, Masuda, Koji and Fukuda, Tadashi It is certified that error appears in the above-identified patent and that said Letters Patent is hereby corrected as shown below:

Title page,
Item [57], ABSTRACT,
Line 5, "extremely;" should read -- extremely, --.

Column 1,
Line 50, "converter" should read -- coverter 5 --.

Column 2,
Line 11, "laser beam;" should read -- laser beam, --.

Column 15,
Line 25, "die" should read -- the --.

Column 16,
Line 1, "the-predetermined", should read -- the predetermined --;
Line 14, "fanning" should read -- forming --;
Line 28, "determines-the", should read -- determines the --;
Lines 28-29, "of-toner", should read -- of toner --; and
Line 29, "depend" should read -- depending --.

Signed and Sealed this

Second Day of May, 2006

JON W. DUDAS
*Director of the United States Patent and Trademark Office*